US005294905A

United States Patent [19]

Pimpis

[11] Patent Number: 5,294,905

[45] Date of Patent: Mar. 15, 1994

[54] CURRENT LIMITING FUSE

[75] Inventor: Robert M. Pimpis, Dover, N.H.

[73] Assignee: Gould Inc., Eastlake, Ohio

[21] Appl. No.: 52,580

[22] Filed: Apr. 23, 1993

[51] Int. Cl.[5] ..... H01H 85/04; H01H 85/43

[52] U.S. Cl. ..... 337/158; 337/242; 337/251; 337/268

[58] Field of Search ..... 337/241, 242, 265, 266, 337/268, 270, 158, 186, 270, 271, 251

[56] References Cited

U.S. PATENT DOCUMENTS 973,250 10/1910 Barricklow .
3,319,027 5/1967 Hitchcock .
3,337,705 8/1967 Salzer .
3,491,322 1/1970 Kozacka .
3,673,533 6/1972 Salzer .
3,697,916 10/1972 Beicher et al. .
3,766,507 10/1973 Jacobs, Jr. .
3,783,428 1/1974 Swain et al. .
4,962,977 10/1990 Suuronen .

FOREIGN PATENT DOCUMENTS 1513486 10/1969 Fed. Rep. of Germany .

*Primary Examiner*—Harold Broome
*Attorney, Agent, or Firm*—Fish & Richardson

[57] ABSTRACT

A fuse that includes an insulative housing, terminals extending through gaps in the bottom of the housing, and a fusible element having ends connected to both of the terminals. The housing includes a four-sided box that is closed at the top and open on the bottom, and a lid for closing the open bottom of the box that is smaller than the open bottom of the box so that, when the lid is in place, two gaps are formed in the bottom and at opposite ends of the housing.

23 Claims, 1 Drawing Sheet

CURRENT LIMITING FUSE

BACKGROUND OF THE INVENTION

The invention relates to current limiting fuses.

Current limiting fuses typically have one or more fusible elements connecting two conducting terminals within an insulative housing. Barricklow U.S. Pat. No. 973,250 describes such a fuse in which the insulative housing is made of porcelain or an equivalent insulative material. Jacobs, Jr. U.S. Pat. No. 3,766,507 and Suuronen U.S. Pat. No. 4,962,977 describe fuses with box-shaped housings.

SUMMARY OF THE INVENTION

In one aspect, the invention features, in general, a fuse which includes an insulative housing that includes a four sided box that is closed on the top and open on the bottom and a lid for closing the open bottom of the box such that, when the lid is in place, there are two gaps between the housing and the lid at opposite ends of the housing. Terminals extend through the gaps, and a fusible element located inside the housing has ends connected to each of the terminals.

In preferred embodiments, the lid is smaller than the opening, thereby providing the gaps. The box has two circular openings nears its top. These openings are located on opposite sides of the box and are arranged coaxially with each other. A self-contained indicator for indicating that the fuse has blown is located in and extends between these holes. The indicator's self-contained design prevents the indicator from being affected by solid fill binder that can be used. It also eases assembly in that the indicator can be easily inserted into the housing, and the indicator also serves as a means for properly locating the terminals in the housing.

In a preferred embodiment, each terminal has a first section and a second section, with the first section being perpendicular to the second section and located in the housing. When the terminals are located in the housing, the first sections of each terminal are parallel to each other. The first section of each terminal also has a notch located at its top. This notch serves to make electrical contact with the self-contained indicator.

The box and lid preferably are injection molded parts made of thermoplastic material and are preferably attached to each other by welding, most preferably ultrasonic welding. This simplifies manufacture because it eliminates the need for fasteners and allows for fast assembly time. Preferably the thermoplastic material includes 20%–40% filler (most preferably 30%–35% filler).

The housing contains arc-quenching fill that is inserted through a hole located in the lid. This fill can be impregnated with a binder solution and cured to provide a solid fill binder that is advantageous because it absorbs energy that would otherwise be transmitted to the housing.

Suitable methods of attaching the fusible element to the terminals include soldering, resistance welding, and ultrasonic welding. The fusible element is preferably attached to the wide front face of the terminals. In some embodiments, slots are located on the wide front faces of the terminals to ease attachment of the fusible element. It should be understood that multiple fusible elements can be used.

Other advantages and features of the invention will be apparent from the following description of the preferred embodiment thereof and from the claims.

DESCRIPTION OF THE PREFERRED EMBODIMENT

The preferred embodiment will now be described.

DRAWINGS

STRUCTURE, MANUFACTURE, AND OPERATION

Figure 1:
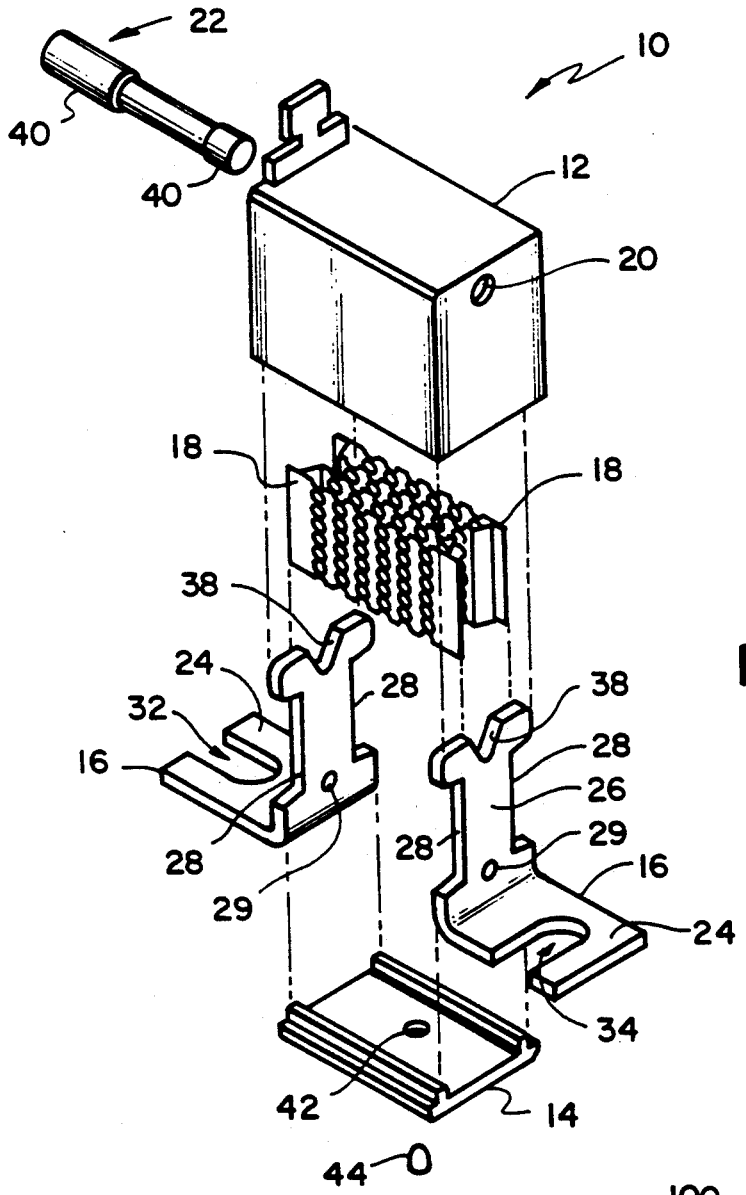
FIG. 1 is an exploded perspective view of a fuse according to the invention.
Figure 2:
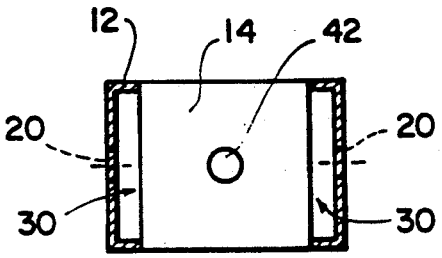
FIG. 2 is a bottom view of a housing according to the invention.

Referring to FIGS. 1 and 2, fuse 10 includes box 12 made of insulative material, lid 14 made of insulative material, terminals 16 made of conducting material, and fusible elements 18 made of conducting material. Each fusible element 18 has two parallel members joined at ends with parallel rows of holes providing notch sections. Lid 14 is smaller than box 12 so that, when lid 14 is attached to box 12, two gaps 30 are formed at opposite ends of the bottom of box 12. Located on opposite sides and near the top of box 12 are two holes 20. These holes are arranged coaxially and are sized to accept the insertion of a self-contained indicator 22. Terminals 16 include external portions 24 and internal portions 26. Internal portions 26 have recessed sides 28, each sized to accept an end of a fusible element 18, and nubs 29 (0.125" diameter and protruding 0.050" inward from the 0.118" thick terminal) to engage the plastic of lid 14 and prevent removal of terminals 16. Internal portions 26 also have notches 38, each sized to contact a metal end cap 40 of self-contained indicator 22. External portions 24 have cutouts 32, 34. Fusible elements 18 are attached to recessed sides 28 by spot welding. Box 12 and lid 14 are made of thermoplastic material and are welded together.

Figure 3:
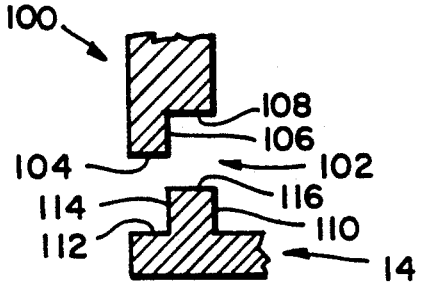
FIG. 3 is a partial sectional view showing the junction of the box and lid of the housing of the FIG. 1 fuse.

FIG. 3 shows the mating portions of lid 14 and box 12. The edge of lid 14 and the bottom of a sidewall 100 of box 12 are stepped to provide a shear joint, which is particularly preferred for semi-crystalline material in order to obtain good joint strength. Sidewall 100 has right angle portion 102 including lower surface 104, vertical surface 106, and upper surface 108. The mating portion of lid 14 has similar right angle portion 110 including lower surface 112, vertical surface 114, and upper surface 116. The overall wall thickness is about 0.091" thick, and there is between 0.012" and 0.016" interference for the vertical surfaces used to permit ultrasonic welding. During such welding, one piece is held fixed, and the other piece is moved toward it and vibrated at 20 KHz. The material of the interfering vertical surfaces melts as the two are brought together, resulting in a shear joint that has good bond strength.

The thermoplastic material has the capability to be melted and reformed while retaining its properties when cooled below its melt point; this is desirable to permit joinder of preformed housing pieces by welding and to avoid the use of adhesives. The material should also have a sufficiently high continuous use temperature so as to maintain structural integrity at elevated temperatures resulting from heating when operating at rated current conditions. Preferably the continuous use temperature (UL746C, 100,000 hour test) is greater than 120° C. Fillers are preferably added to the thermoplastic resins to reduce the cost of the material and to improve the mechanical properties of the plastic by forming a support matrix within the plastic. Fillers tend to increase the continuous use temperature of the thermoplastic material, thereby providing improved structural integrity at elevated temperatures. However, depending on the resin and filler material, increasing filler concentration beyond a certain amount tends to reduce the strength; also, increasing the concentration beyond a certain amount may tend to negatively affect the ability to create strong bonds using ultrasonic welding. It accordingly is desirable to increase the continuous use temperature as much as possible while still achieving good bond strength using ultrasonic welding. Suitable filler materials include fiber glass, calcium carbonate, carbon fiber, cellulose, and graphite fiber. In general, thermoplastic materials with a continuous use temperature above 120° C. and a filler concentration between 20% and 40% (most preferably between 30% and 35%) provide necessary strength at elevated temperature while still permitting processing by ultrasonic welding. The thermoplastic material also preferably includes a flame retardant, is nontoxic (not give off toxins when at elevated temperature), and has high dielectric strength (above 400 volts/mil).

A suitable material for the thermoplastic material is glass reinforced polyphthalamide semicrystalline resin containing 33% glass filler available under the Amodel AF-1133 VO trade designation from Amoco Performance Products, Inc., Atlanta, Ga. This material includes a flame retardant and has a continuous use temperature of 125° C. per UL746C.

Other suitable materials include a highly crystalline Nylon 4.6, having 30% glass filler, and available from DSM Corp. under the Stanyl trade designation; polyphenylene sulfide having 30% glass filler and available from Phillips Corp. under the Ryton trade designation; and glass-filled liquid crystal polymers such as Xydar from Amoco, Supec from General Electric, and Vectra from Hoechst Celanese.

In manufacture, the self-contained indicator 22 is pressed into the box 12 through holes 20. The ends of fusible elements 18 (a particular fuse can include one or a plurality of fusible elements 18) are attached to recessed sides 28 by soldering, resistance welding, or ultrasonic welding while terminals 16 are rigidly fixtured. Box 12 is then placed over the still-fixtured subassembly of terminals 16 and attached fusible elements 18 such that notches 38 of terminals 16 contact metal end caps 40 of indicator 22, at which time the fixture is removed. Box 12 and lid 14 are then ultrasonically welded together, as has already been described. As lid 14 is moved toward box 12, the lower surface of lid 14 (the upper surface of lid 14 in the position shown in FIG. 1) engages nubs 29, biasing terminals 16 downward and guaranteeing good contact of caps 40 at notches 38. The plastic melts about nubs 29, acting to lock terminals 16 in place and preventing their removal.

The housing is filled with quartz fill (not shown) through fill hole 42 in lid 14, and the entire is assembly is vibrated to maximize compaction of the quartz fill. The quartz fill is then impregnated with a binder solution through fill hole 42. After the binder solution 48 is cured, fill hole 42 is sealed with a preformed metal plug or a non-conductive potting 44.

Other embodiments of the invention are within the scope of the following claims.

What is claimed is:

1. A fuse comprising an insulative housing, said housing comprising a box having four sides, a closed top, and an open bottom, and a lid for closing said box, said lid being smaller than said open bottom of said box, said housing having two gaps formed between the box and the lid at opposite ends of said bottom;

terminals extending through said gaps, each of said terminals having an internal portion inside said housing and an external portion outside of said housing; and a fusible element having ends connected to respective internal portions of said terminals.

2. The fuse of claim 1 wherein said gaps are provided by recesses in side edges of said lid.

3. The fuse of claim 1 wherein said box has two circular openings located near said top of said box, said openings being located in opposite sides of said box and arranged coaxially with each other, and said fuse further includes an indicator located in said box between said circular openings.

4. The fuse of claim 1 further comprising a plurality of fusible elements having ends connected to respective internal portions of both of said terminals.

5. The fuse of claim 1 wherein each of said terminals has a first section and a second section, said second section being essentially perpendicular to said first section.

6. The fuse of claim 1 wherein said internal portions of said terminals are parallel to each other.

7. The fuse of claim 5 further comprising a plurality of fusible elements having ends connected to respective internal portions of both of said terminals, wherein said fusible elements are parallel to each other.

8. The fuse of claim 1 wherein each of said internal portions of said terminals are parallel to each other.

9. The fuse of claim 8 wherein ends of said fusible elements are attached to recessed side surfaces of said internal portions.

10. The fuse of claim 1 wherein said box and said lid are made of thermoplastic material and are welded to each other.

11. The fuse of claim 10 wherein said thermoplastic material has a continuous use temperature greater than 120° C.

12. The fuse of claim 11 thermoplastic material includes a filler.

13. The fuse of claim 12 wherein said thermoplastic material has between 20% and 40% filler.

14. The fuse of claim 13 wherein said thermoplastic material has between 30% and 35% filler.

15. The fuse of claim 13 wherein said thermoplastic material comprises highly crystalline Nylon 4.6.

16. The fuse of claim 13 wherein said thermoplastic material comprises polyphthalamide.

17. The fuse of claim 13 wherein said thermoplastic material comprises polyphenylene sulfide.

18. The fuse of claim 13 wherein said thermoplastic material comprises liquid crystal polymer.

19. The fuse of claim 1 wherein said housing contains arc-quenching fill.

20. The fuse of claim 1 wherein said fusible element is resistance welded to said internal portions of said terminals.

21. The fuse of claim 1 wherein said fusible element is ultrasonically welded to said internal portions of said terminals.

22. The fuse of claim 2 wherein each of said internal portions of said terminals are parallel to each other and contain notches that receive and have surfaces making electrical contact with said indicator.

23. The fuse of claim 7 wherein said internal portions have nubs that protrude so as to prevent removal of said terminals from said box and lid.

* * * * *

UNITED STATES PATENT AND TRADEMARK OFFICE

CERTIFICATE OF CORRECTION

PATENT NO. : 5,294,905

DATED : March 15, 1994

INVENTOR(S) : Robert M. Pimpis et al.

It is certified that error appears in the above-indentified patent and that said Letters Patent is hereby corrected as shown below:

On the title page item [75],

--Michel A. Goldstein, Randolph, NJ; George F. Walker, Jr., Lee, NH-- should be added as inventors.

Signed and Sealed this

Twenty-eighth Day of November 1995

*Attest:*

Bruce Lehman

BRUCE LEHMAN

*Attesting Officer*

*Commissioner of Patents and Trademarks*